US005463273A

United States Patent [19]

Kato et al.

[11] Patent Number: 5,463,273

[45] Date of Patent: Oct. 31, 1995

[54] DIMPLED IMAGE DISPLAY FACEPLATE FOR RECEIVING MULTIPLE DISCRETE PHOSPHOR DROPLETS AND HAVING CONFORMAL METALLIZATION DISPOSED THEREON

[75] Inventors: Yumiko Kato, Mesa; James E. Jaskie, Scottsdale; David A. Wiemann, Higley, all of Ariz.

[73] Assignee: Motorola, Schaumburg, Ill.

[21] Appl. No.: 237,818

[22] Filed: May 4, 1994

[51] Int. Cl.[6] ..... H01J 29/18

[52] U.S. Cl. ..... 313/461; 313/462; 313/470; 313/472; 359/893

[58] Field of Search ..... 313/461, 462, 313/477 R, 470, 472; 359/893; 220/2.1 A, 2.3 A

[56] References Cited

U.S. PATENT DOCUMENTS 2,705,765 4/1955 Geer ..... 313/461 X
2,955,348 10/1960 Healy ..... 313/470 X
3,761,756 9/1973 Miura et al. ..... 313/470
5,099,171 3/1992 Daiku et al. ..... 313/477 R X

FOREIGN PATENT DOCUMENTS 0876882 12/1942 France ..... 313/462

*Primary Examiner*—Sandra L. O'Shea
*Assistant Examiner*—Ashok Patel
*Attorney, Agent, or Firm*—Eugene A. Parsons

[57] ABSTRACT

An image display faceplate having a plurality of recesses (dimples) formed therein for receiving discrete phosphor droplets and having a conformal metallization layer disposed thereon is provided. The phosphor system so described may be dispensed onto the faceplate without the need for multiple sequential depositions, maskings, and material removals and provides for a single step deposition of dis-similar phosphor materials of which the phosphor system is comprised.

5 Claims, 1 Drawing Sheet

DIMPLED IMAGE DISPLAY FACEPLATE FOR RECEIVING MULTIPLE DISCRETE PHOSPHOR DROPLETS AND HAVING CONFORMAL METALLIZATION DISPOSED THEREON

FIELD OF THE INVENTION

This invention relates generally to an image display faceplate (viewing screen) and more particularly to a cathodoluminescent phosphor image display viewing screen.

BACKGROUND OF THE INVENTION

Cathodoluminescent phosphor viewing screens are known and widely employed for a variety of image display devices such as, for example, television and computer monitors.

Phosphor systems commonly employed for image displays include those which utilize a plurality of dis-similar phosphor materials to realize full color capable displays. For example, three color phosphor systems which provide discrete sub-pixel phosphor areas each of one of red, green, or blue photon emitting material are realized by multiple depositions, maskings, and patternings of the dis-similar phosphor materials. The multiple depositions, maskings, and patternings greatly complicates the fabrication process, adding a great amount of time, labor and cost to the process.

Phosphor screens for cathode ray tubes (CRTs) are usually deposited by the slurry method. A solution containing one of the three primary-color phosphors (i.e., red, green, blue), aqueous PVA and aqueous $(NH_4)_2Cr_2O_2$ is made into a slurry and dispersed onto a rotating horizontal flat panel (the screen). The flat panel is spun until the slurry is evenly distributed and then it is exposed through a shadow mask. The unexposed regions are rinsed away in water. This process is then repeated for each of the other colors.

The slurry process described above is subject to problems such as inhomogeneous screening, pinhole formation during rinsing, cross-color contamination, and coagulation of particles. In addition, alignment of the color stripes must be maintained. These are a common shortcomings of the known art.

Accordingly, there exists a need for a means to provide for an improved multi-color phosphor system which may overcome at least some of the shortcomings of the prior art.

It is one purpose of the present invention to provide an image display faceplate with phosphor system which does not require the complex fabrication methods of the known art.

It is another purpose of the present invention to provide an image display viewing screen with associated multi-colored phosphor system wherein each of the plurality of dis-similar phosphor materials may be deposited (dispensed) as part of a single deposition step by employing a plurality of phosphor material dispensing means.

It is a further purpose of the present invention to provide a cathodoluminescent image display viewing screen faceplate having a plurality of recessed regions formed therein each for accepting a prescribed amount of one of a plurality of dis-similar phosphor materials.

SUMMARY OF THE INVENTION

The above described problems and others are at least partially solved and the above purposes and others are realized through provision of a multi-color image display viewing screen including a plurality of selectively oriented recessed regions disposed at a faceplate major surface and extending into the faceplate and a plurality of phosphor materials each disposed into some of the plurality of recessed regions such that a full color viewing screen comprised of a plurality of discrete sub-pixel elements can be provided by performing a single step phosphor material deposition.

DETAILED DESCRIPTION OF THE DRAWINGS

Figure 1:
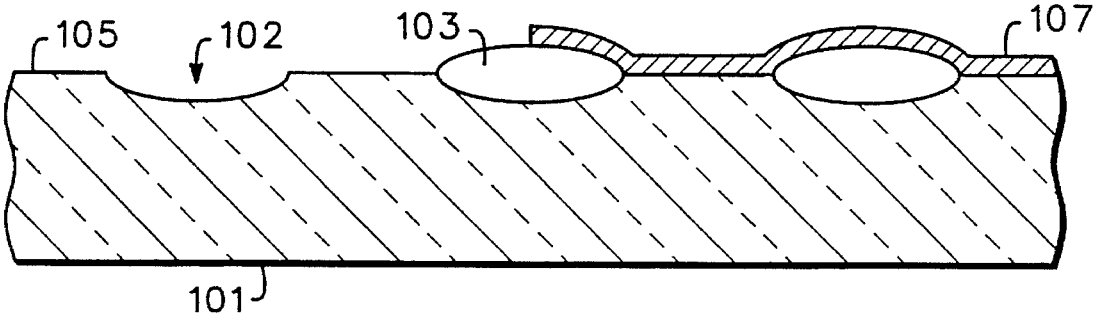
FIG. 1 is a simplified side-elevational representation of an image display faceplate in accordance with the present invention, portions thereof broken away.

Referring now to FIG. 1 there is depicted a side elevational representation of an image display viewing screen 100 including a substantially optically transparent image display faceplate 101 (hereinafter "faceplate") having a major surface 105. Faceplate 101 has formed therein a plurality of depressions or recesses 102 extending into the faceplate 101 from the major surface 105. Recesses 102 may be realized by one of, for example only and not to indicate a limitation in any way, molding during sheet material formation, or micromachining subsequent to sheet formation, etc. One possibility is a photomachineable glass manufactured by Corning Inc. Using this material, holes as small as 4 mils can be created with a centerline tolerance of ±1 mil. Another option is wet etching through an inexpensive dry mask. In neither case would the formation of recesses 102 be problematic, as long as the diameter of each recess 102 is significantly greater than the depth. Generally, the depth of recesses 102 is determined by the density of the phosphor required to handle the excitation electron beam. This is typically on the order of 1–10 microns.

A phosphor material 103 is deposited into recesses 102 so as to substantially fill recesses 102 and form relatively uniform sized dots of phosphor on the surface of faceplate 101. One technique used to dispense the phosphor material 103 into the recesses 102 is by employing one or a plurality of dispensing tips (not shown) brought into proximity of one or more desired recesses 102 to dispense a measured amount of a liquid phosphor material thereinto. The liquid phosphor material is formed by dispersing phosphor material 103 in a viscous medium. The dispensing tips operate similar to a hypodermic needle, except that they are generally operated by a pulsed pressure source, causing each dispensing tip to dispense the correct amount of liquid phosphor material. Utilizing this process, liquid phosphor material is injected or dispensed into each recess 102, individually or any number at a time. For example, if recesses 102 are oriented in rows they can be filled one or more rows at a time, or if different colors of phosphor are used, all recesses containing a similar color can be filled first, then a second color, etc. The dimpled shape of recesses 102 ensures that different phosphor materials 103 are retained in proper alignment without danger of cross-contamination.

Once all of recesses 102 are filled, faceplate 101 is carefully placed in a drying oven or other facility for evaporating off excess liquid from the liquid phosphor material so that only phosphor material 103 remains adhered to faceplate 101 in recesses 102. It is also possible that the liquid phosphor material could be chemically fixed, as with photoresist.

A conformal metallization layer 107 is deposited onto phosphor material 103 and exposed portions of major surface 105 to function as a conductive anode to collect electrons which impinge on/in phosphor material 103 and also to function as a reflective layer to direct photon energy, which originates in phosphor material 103 as a result of electron impingement. A high aspect ratio is not desirable for recesses 102, not only because they would be more difficult to fabricate but also because a continuous conformal metallization layer 107 over the entire surface 105 of faceplate 101 is desired. Conformal metallization layer 107 is, for example, deposited by evaporation as with conventional CRT screens and typically includes a thin layer of aluminum. If, for example, recesses 102 are formed as dimples with gradually sloped edges, as illustrated in FIG. 1, conformal metallization layer 107 can be deposited over recesses 102 in a continuous layer with no loss of coverage at a sharp corner.

Figure 2:
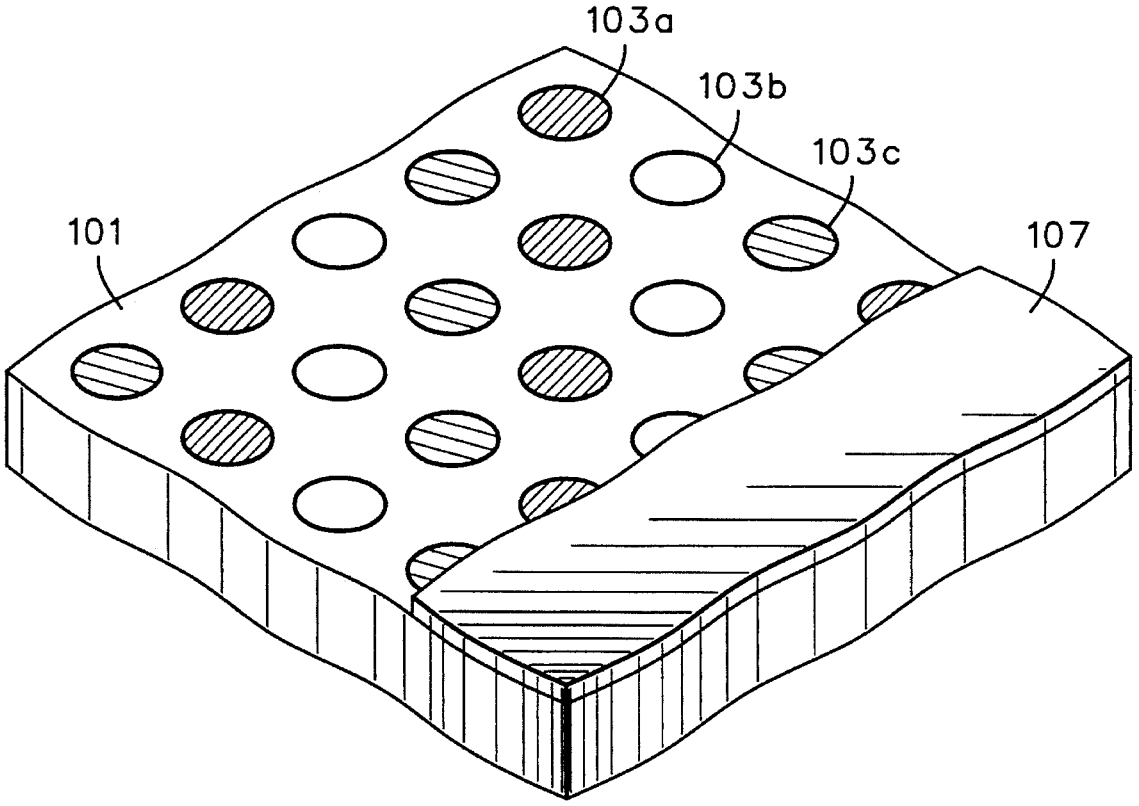
FIG. 2 is a perspective view of the image display faceplate depicted in FIG. 1, portions thereof broken away.

FIG. 2 is a partial top plan view representation of the image display viewing screen as described previously with reference to FIG. 1 and wherein features previously identified in FIG. 1 are similarly referenced. FIG. 2 further depicts that a plurality of discrete regions of dissimilar phosphor materials 103*a*, 103*b*, 103*c* have been selectively disposed each into some of the plurality of preferentially oriented recessed regions to provide a pattern of dis-similar phosphor materials which may be employed to realize a multi-color image display. Each set, or plurality, of dis-similar phosphor materials 103*a*, 103*b*, 103*c*, forms a pixel of the faceplate, and the dis-similar phosphor materials of each pixel cooperate in a manner known in the art to produce virtually any desired color. While the three dis-similar phosphor materials are illustrated in a line in this disclosure, for convenience of description, it will be understood that they could be formed in any other close group, such as a triangle, etc. By providing the plurality of recessed regions 102 and subsequently selectively dispensing phosphor material 103*a*, 103*b*, 103*c* into each of the plurality of recessed regions, by employing a plurality of phosphor material dispensing means such as, for example, a system of micro-nozzle material dispensers the entire phosphor system may be provided in a single step without the need for masking, patterning, or material removal steps.

It should also be understood that in some applications it may be desirable to form the recessed regions into a prescribed pattern other than a plurality of pixels. For example, in some specific applications it may be desirable to form areas of recessed regions, or dis-similar phosphor materials, without forming multi-color pictures. The faceplate might include, a red area for certain messages, a green area for other information, a blue area for still other information, etc. In these specific application the screen would contain a plurality of recessed regions with different and dis-similar phosphor materials in different regions, but each recessed region could form a pixel, rather than a plurality of recessed regions forming a multi-color pixel.

Besides the easier processing for the fabrication of the faceplate, another advantage of the dimpled faceplate is its applicability in a large-area flat panel display based on individual emitters, such as field emission emitters. In this case the excitation source for the phosphor material includes many discrete emitters, rather than one electron gun, as in a CRT. The dimpled faceplate allows alignment of each subpixel (e.g. 103*a*, 103*b*, 103*c*) to an emitter or set of emitters. This is especially true if the emitters are also fabricated in similar patterns (e.g. lines, triangles, circles) corresponding to those on the faceplate.

Accordingly, an image display faceplate with phosphor system is disclosed which does not require the complex fabrication methods of the known art. Further, an image display viewing screen with associated multi-colored phosphor system is disclosed wherein each of the plurality of dis-similar phosphor materials may be deposited (dispensed) as part of a single deposition step by employing a plurality of phosphor material dispensing means. Also, a cathodoluminescent image display viewing screen faceplate is disclosed having a plurality of recessed regions formed therein each for accepting a prescribed amount of one of a plurality of dis-similar phosphor materials.

While we have shown and described specific embodiments of the present invention, further modifications and improvements will occur to those skilled in the art. We desire it to be understood, therefore, that this invention is not limited to the particular forms shown and we intend in the appended claims to cover all modifications that do no depart from the spirit and scope of this invention.

What is claimed is:

1. An image display faceplate comprising a major surface and a plurality of uniform recessed regions oriented to provide a prescribed pattern and extending into the faceplate, each of the recessed regions being formed as a dimple with a diameter, a depth and gradually sloped edge and with the diameter of each dimple being significantly greater than the depth, and the faceplate further including a plurality of dis-similar phosphor materials with a different phosphor material of the plurality, of dis-similar phosphor materials disposed in each recessed region.

2. An image display faceplate as claimed in claim 1 wherein the plurality of recessed regions are each formed so that the depth of each recess is on the order of 1–10 microns.

3. The faceplate of claim 1 and further comprising a conformal layer of conducting material substantially covering the major surface of the faceplate and the dis-similar phosphor materials disposed in each recessed region.

4. An image display faceplate comprising a major surface and a plurality of uniform recessed regions oriented to provide a prescribed pattern, the plurality of recessed regions being oriented to form a plurality of pixels disposed at the major surface and extending into the faceplate with each pixel including a set of the plurality of recessed regions, each of the recessed regions being formed as a dimple with a diameter a depth and radially sloped edges and with the diameter of each dimple being significantly greater than the depth, and the faceplate further including a plurality. Of dis-similar phosphor materials with a different phosphor material of the plurality of dis-similar phosphor materials disposed in each recessed region.

5. A multi-color image display viewing screen comprising:

a faceplate having a major surface;

a plurality of uniform selectively oriented recessed regions disposed at the faceplate major surface and extending into the faceplate, each of the recessed regions being formed as a dimple with a diameter, a depth and gradually sloped edges and with the diameter of each dimple being significantly greater than the depth;

a plurality of dis-similar phosphor materials with a different phosphor material of the plurality of dis-similar phosphor materials disposed in each recessed region, such that a full color viewing screen comprised of a plurality of discrete sub-pixel elements is provided; and a conformal layer of conducting material substantially covering the major surface of the faceplate and the dis-similar phosphor materials disposed in each recessed region.

* * * * *

UNITED STATES PATENT AND TRADEMARK OFFICE

CERTIFICATE OF CORRECTION

PATENT NO. : 5,463,273

DATED : October 31, 1995

INVENTOR(S) : Kato et al.

It is certified that error appears in the above-indentified patent and that said Letters Patent is hereby corrected as shown below:

Claim 4, column 4, line 54, "radially" should read --gradually--.

Claim 4, column 4, lines 56-57, "than the depth, and the faceplate further including a plurality. Of dis-similar phosphor materials with a different phosphor" should read --than the depth, and the faceplate further including a plurality of dis-similar phosphor materials with a different phosphor--.

Signed and Sealed this

Thirteenth Day of February, 1996

Bruce Lehman

*Attest:*

BRUCE LEHMAN

*Attesting Officer*

*Commissioner of Patents and Trademarks*